US006622979B2

(12) United States Patent
Valiulis

(10) Patent No.: US 6,622,979 B2
(45) Date of Patent: Sep. 23, 2003

(54) STEM AND SCAN LOCKING HOOKS

(75) Inventor: Stanley C. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 09/820,431

(22) Filed: Mar. 29, 2001

(65) Prior Publication Data

US 2001/0013567 A1 Aug. 16, 2001

(51) Int. Cl.[7] ..... A47B 96/06

(52) U.S. Cl. ..... 248/220.42; 248/220.41; 248/553; 211/7; 211/59.1; 70/57.1; 70/34

(58) Field of Search ..... 248/553, 220.31, 248/220.41, 220.42; 70/57.1, 58, 34, 14, 62; 211/7, 59.1, 40, 94.07

(56) References Cited

U.S. PATENT DOCUMENTS

| | | | | |
|---|---|---|---|---|
| 254,284 | A | 2/1882 | Dean | |
| 457,959 | A | 8/1891 | Pursell | |
| 886,480 | A | 5/1908 | Crowther | |
| 920,132 | A | 5/1909 | Greener | |
| 1,022,980 | A | 4/1912 | Stringer | |
| 1,117,126 | A | 11/1914 | Bailey | |
| 1,322,728 | A | 11/1919 | Read | |
| 1,446,760 | A | 2/1923 | Miller | |
| 1,488,390 | A | 3/1924 | Hill et al. | |
| 1,592,696 | A | 7/1926 | Heyer | |
| 1,644,155 | A | 10/1927 | Scott | |
| 1,744,984 | A | 1/1930 | Page | |
| 1,856,239 | A | 5/1932 | Buckley | |
| 1,863,503 | A | 6/1932 | Schlitz | |
| 2,073,351 | A | 3/1937 | Osman | 129/38 |
| 2,089,300 | A | 8/1937 | Schlitz | 70/23 |
| 2,626,061 | A | 1/1953 | Girouard | 211/59 |
| 3,084,802 | A | 4/1963 | Ittiner | 211/4 |
| 3,472,385 | A | 10/1969 | Shapiro et al. | 211/7 |
| 3,494,583 | A | 2/1970 | Parr | 248/221 |
| 3,516,719 | A | 6/1970 | Weisblat | 312/216 |
| 3,525,242 | A | 8/1970 | Young | 70/231 |
| 3,545,711 | A | 12/1970 | Scheneman | 248/223 |
| 3,622,011 | A | 11/1971 | Snow | 211/59 |
| 3,655,061 | A | 4/1972 | Peschcke-Koedt | 211/57 |
| 3,763,675 | A | 10/1973 | Hofmeister et al. | 70/232 |
| 3,785,501 | A | 1/1974 | Canning | 211/7 |
| 3,802,230 | A | 4/1974 | Tickett | 70/34 |
| 3,827,569 | A | 8/1974 | Canning | 211/7 |
| 3,934,727 | A | 1/1976 | Brefka | 211/7 |
| 4,155,458 | A | 5/1979 | Moline | 211/4 |
| 4,217,986 | A | 8/1980 | Bronw | 211/57.1 |
| 4,289,242 | A | 9/1981 | Kenyon | 211/4 |
| 4,441,619 | A | 4/1984 | Gibitz | 211/60 |
| 4,462,497 | A | 7/1984 | Maule | 211/7 |
| 4,474,300 | A | 10/1984 | Entis | 211/57.1 |
| 4,506,856 | A | 3/1985 | Rich et al. | 248/222.1 |
| 4,513,592 | A | 4/1985 | Aghay | 70/34 |
| 4,519,225 | A | 5/1985 | Simmler et al. | 70/34 |
| 4,614,097 | A | 9/1986 | Signorelli | 70/34 |
| 4,678,151 | A | 7/1987 | Radek | 248/220 |

(List continued on next page.)

FOREIGN PATENT DOCUMENTS

WO WO 95/31625 * 5/1995

*Primary Examiner*—Gwendolyn Baxter
(74) *Attorney, Agent, or Firm*—Leydig, Voit & Mayer, Ltd.

(57) ABSTRACT

A locking hook assembly is provided for securely displaying merchandise on a vertical support. The locking hook assembly generally comprises a mounting bracket structured for connection to the vertical support. A hook of generally circular cross-section has an inner end fixed to the mounting bracket and projects outwardly therefrom to an outer end. The hook's outer end has a reduced diameter portion of generally semi-circular cross-section, and the reduced diameter portion includes a notch. To prevent removal of merchandise at the outer end, a lock has a semi-circular opening shaped to receive the reduced diameter portion and selectively engage the notch.

22 Claims, 5 Drawing Sheets

U.S. PATENT DOCUMENTS

| | | | | |
|---|---|---|---|---|
| 4,840,049 | A | 6/1989 | Russo | 70/34 |
| 4,882,868 | A | 11/1989 | Fast | 40/657 |
| 4,953,371 | A | 9/1990 | Applebaum | 70/32 |
| 5,022,243 | A | 6/1991 | Embry et al. | 70/34 |
| 5,024,073 | A | 6/1991 | Lloyd | 70/491 |
| 5,027,622 | A | 7/1991 | Hatch et al. | 70/14 |
| 5,027,624 | A | 7/1991 | Aghay et al. | 70/34 |
| 5,127,244 | A | 7/1992 | Meyers | 70/2 |
| 5,251,767 | A | 10/1993 | Wiederer | 211/124 |
| 5,259,220 | A | 11/1993 | Fredrickson | 70/14 |
| 5,269,161 | A | 12/1993 | Stillwagon | 70/34 |
| 5,275,027 | A | 1/1994 | Eklof et al. | 70/14 |
| 5,375,802 | A | 12/1994 | Branham, II | 248/231 |
| 5,407,170 | A | 4/1995 | Slivon et al. | 248/552 |
| 5,441,941 | A | 8/1995 | Kähönen et al. | 70/34 |
| 5,467,619 | A | 11/1995 | Stillwagon et al. | 70/34 |
| 5,493,879 | A | 2/1996 | Bison | 70/62 |
| 5,509,542 | A | 4/1996 | Simmerman et al. | 211/124 |
| 5,517,835 | A | 5/1996 | Smith | 70/14 |
| 5,540,065 | A | 7/1996 | Wyers | 70/26 |
| 5,551,577 | A | 9/1996 | Hagopian | 211/4 |
| 5,588,537 | A | 12/1996 | Hagopian | 211/4 |
| 5,597,150 | A | 1/1997 | Stein et al. | 248/551 |
| 5,603,416 | A | 2/1997 | Richardson et al. | 211/70.6 |
| 5,624,040 | A | 4/1997 | Hono | 211/4 |
| 5,676,258 | A | 10/1997 | Leyden et al. | 211/7 |
| 5,689,978 | A | 11/1997 | Eklof et al. | 70/62 |
| 6,003,685 | A | 12/1999 | Malin | 211/7 |

* cited by examiner

STEM AND SCAN LOCKING HOOKS

FIELD OF THE INVENTION

The present invention relates generally to wire hangers or hooks for displaying merchandise, and more particularly relates to hooks which can be locked to secure merchandise displayed on the hook.

BACKGROUND OF THE INVENTION

Many types of merchandise are packaged and sold in containers hanging on display hooks at stores such as supermarkets, department stores, retail stores, etc. In many stores, pegboard is used in conjunction with the projecting arm or hook to support a series of such merchandise. These types of display hooks are provided with one or more rods or bars capable of hanging merchandise by inserting the free end of the hook through holes punched in the merchandise container. The containers, therefore, can easily be removed from the hooks by simply pulling the container off the end of the bar. Accordingly, conventional display hooks have a shortcoming in that shoplifting is easily conducted.

BRIEF SUMMARY OF THE INVENTION

The present invention provides a lock and hook assembly for securely displaying merchandise on a vertical support. The lock and hook assembly comprises a mounting bracket structured for connection to the vertical support. A hook of generally circular cross-section has an inner end fixed to the mounting bracket and projects outwardly therefrom to an outer end. The hook's outer end has a reduced diameter portion of generally semi-circular cross-section, and the reduced diameter portion includes a notch. To prevent removal of merchandise at the outer end, a lock has a semi-circular opening shaped to receive the reduced diameter portion and selectively engage the notch.

Preferably, the lock and hook assembly further includes a screw and anchor, wherein the mounting bracket includes a hole sized to receive the screw. The screw and anchor cooperate to clamp the mounting bracket to the vertical support. Also, the reduced diameter portion of the hook may further include a second notch to be engaged by the lock. Preferably, the second notch is radially spaced from the notch by 90° and is smaller than the notch. Most preferably, the first notch is upwardly opening, and the second notch is laterally opening.

In accordance with an aspect of the present invention, an axial facing stop surface is formed where the hook portion of circular cross-section meets the reduced diameter hook portion of semi-circular cross-section. The stop surface limits the inward movement of the lock, while the semi-circular shape of the reduced diameter portion cooperates with the semi-circular opening in the lock to radially position the lock on the hook. These features allow the lock to be reliably positioned on the hook to secure the merchandise thereon and prevent pilfering.

According to another aspect of the present invention, the hook of the lock and hook assembly may comprise a stem hook or a scanning hook. The scanning hook typically includes an upper arm and a lower arm. According to the present invention, the lower arm includes the reduced diameter portion of generally semi-circular cross-section and having the first notch.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
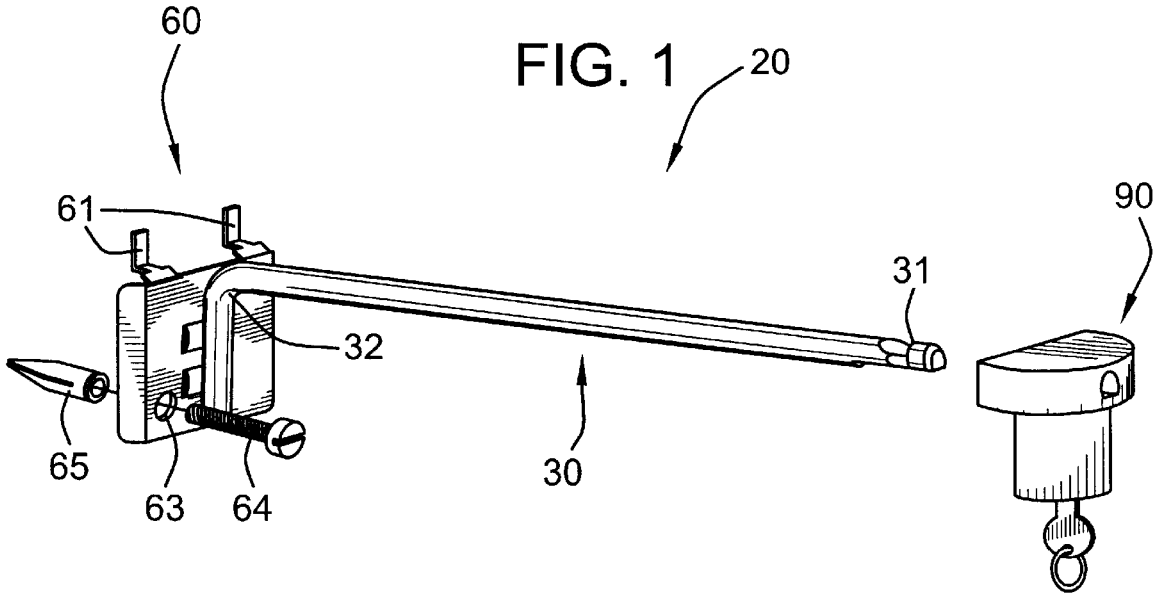
FIG. 1 is a perspective view of an embodiment of a locking hook assembly constructed in accordance with the teachings of the present invention.

Referring now to the drawings, FIG. 1 illustrates an embodiment of a locking hook assembly 20 constructed in accordance with the teachings of the present invention. The locking hook assembly 20 generally comprises a hook 30 supported at one end by a mounting bracket 60, the other end adapted to receive a lock 90 to prevent pilfering and unauthorized removal of merchandise from the hook 30. As further illustrated in FIG. 2, the mounting bracket 60 is constructed to be mounted to a pegboard 15 which supports the locking hook assembly 20 in a display position. The mounting bracket 60 may be constructed to mount to any known vertical support such as slatwall, crossbars, vertical tubes, channels, as is well known in the art.

Figure 2:
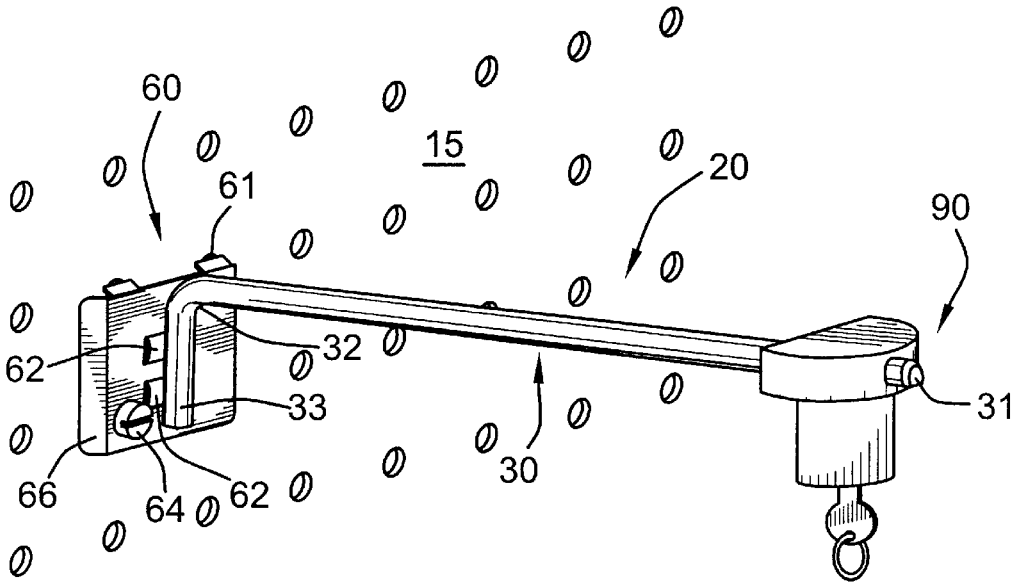
FIG. 2 is a perspective view of the locking hook assembly of FIG. 1 mounted to a vertical support.

The inner end 32 of the hook 30 is downwardly turned, angled relative to the longitudinal axis of the hook 30, and is adapted to be fixed to the mounting bracket 60. In the preferred embodiment, the mounting bracket 60 includes a pair of bosses 62 suitable for welding the downwardly turned end 33 of the hook 30 to the mounting bracket 60. The mounting bracket 60 includes a pair of ears 61 for mounting the locking hook assembly 20 to the pegboard 15. The mounting bracket 60 also preferably includes a slot 63 sized to receive a screw 64. The screw 64 cooperates with an anchor 65 to mount the bracket to the pegboard or vertical support 15, as shown in FIG. 2.

Figure 3:
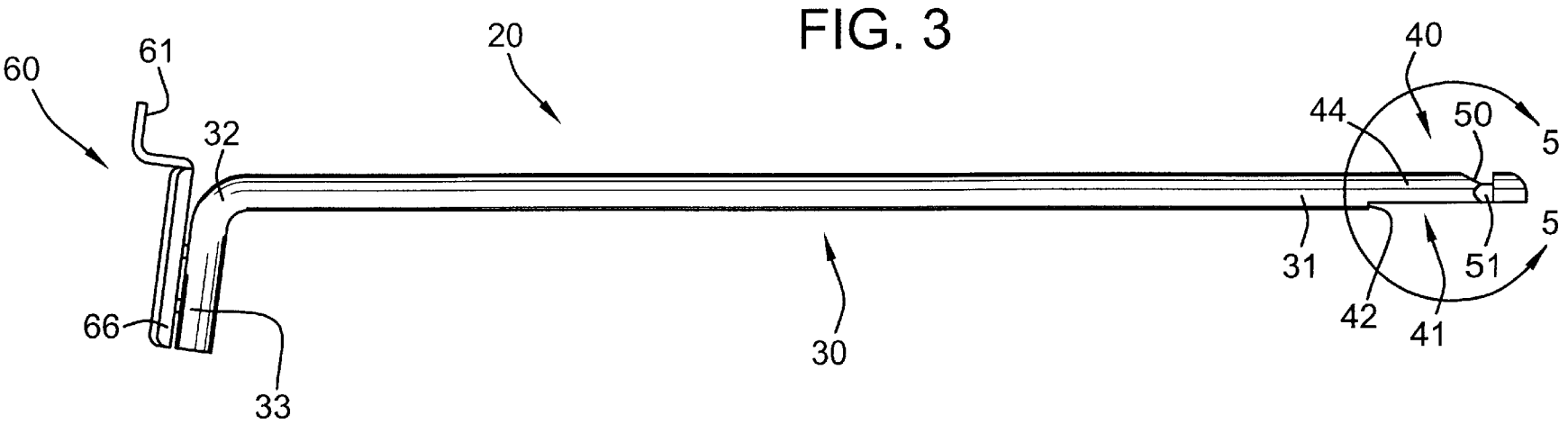
FIG. 3 is a side view of the locking hook assembly of FIG. 1.
Figure 4:
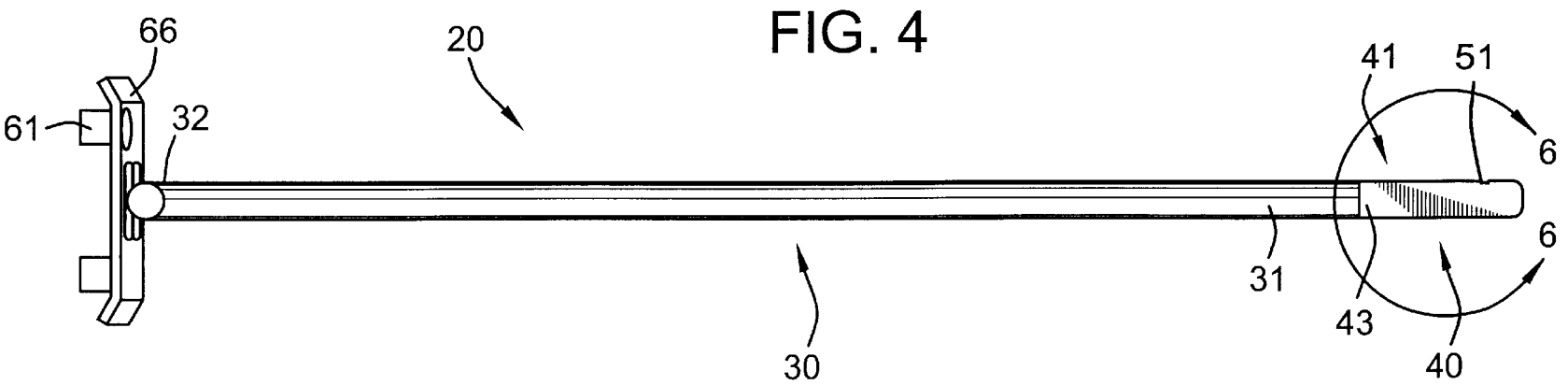
FIG. 4 is a bottom view of the locking hook assembly of FIG. 1.

FIGS. 3 and 4 illustrate side and bottom views, respectively, of the locking hook assembly 20 without the lock 90. In the preferred embodiment, the hook 30 is of a generally circular cross-section, and defines a longitudinal axis between the inner end 32 and the outer end 31. The inward end 32 includes a turned portion 33 fixed to the mounting bracket 60 for attachment to a vertical support. The outer end 31 is constructed to receive the lock 90 (FIG. 2) to prevent pilfering. The reduced diameter portion 40 is defined by a cut-away section 41 which leaves an axial facing stop surface 42 to limit the inward movement of the lock. The reduced diameter portion 40 further includes a first notch 50 which the lock can selectively engage to secure the hook 30. Most preferably, the reduced diameter portion 40 further includes a second notch 51. In the illustrated embodiment, the second notch 51 is radially spaced from the first notch 50 by 90°, wherein the first notch 50 is upwardly opening and the second notch 51 is laterally opening. The cut-away section 41 further defines a flat outer surface 43 (FIG. 4). The flat outer surface 43 meets the semi-annular outer surface 44 to define the outer surface of the free end 40.

Figure 7:
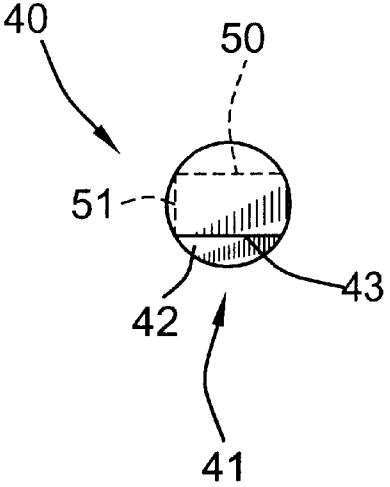
FIG. 7 is an end view of the locking hook assembly denoted by lien 7 in FIG. 5.
Figure 5:
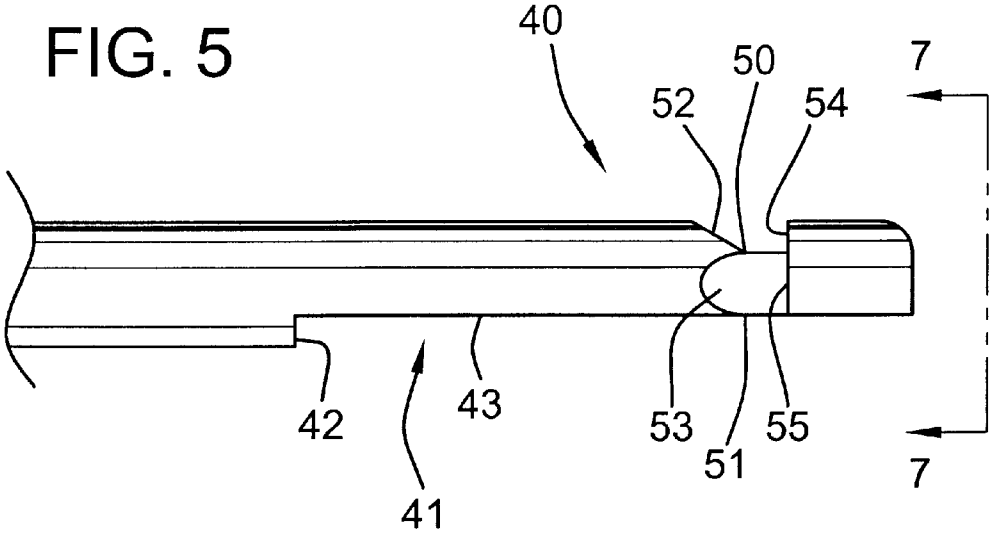
FIG. 5 is a detailed view of the portion of the locking hook assembly denoted by line 5 in FIG. 3.
Figure 6:
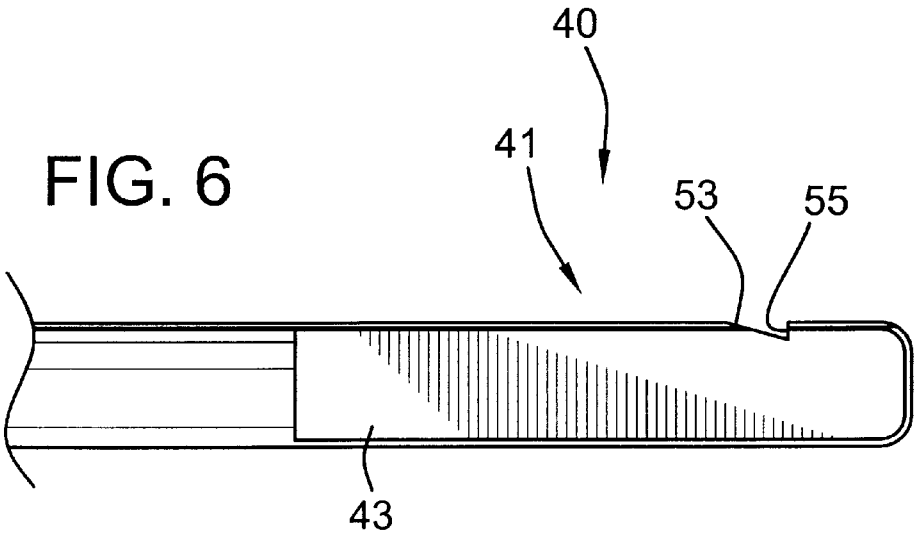
FIG. 6 is a detailed view of the portion of the locking hook assembly denoted by line 6 in FIG. 4.

FIGS. 5, 6 and 7 illustrate detailed views of the free or outer end 40 of the display hook 30. The view of FIG. 5 is indicated by line 5—5 in FIG. 3, while the view of FIG. 6 is indicated by the line 6—6 in FIG. 4. FIG. 7 represents an end view as indicated by line 7—7 in FIG. 5. The reduced diameter portion 40 includes cut-away section 41 defining an axially facing stop surface 42 and flat surface 43. The reduced diameter portion 40 includes a first notch 50 and a second notch 51. The first notch 50 includes an angled guide surface 52 on the inward end of the notch 50 and an axially facing stop surface 54 at the outer end of the notch 50. The second notch 51 includes an angled guide surface 53 at the inward end and an axially facing stop surface 55 at the outer end of the notch 51. Generally, the second notch 51 is generally smaller than the first notch 50, and is radially spaced 90° therefrom. The axially facing stop surfaces 54, 55 are both perpendicular to the longitudinal axis of the hook 30. Preferably, the angled guide surface 52 of the first notch 50 is disposed at a 30° angle relative to the longitudinal axis. Preferably, the angled guide surface 53 of the second notch 51 is disposed at a 15° angle relative to the longitudinal axis. Where the main portion of the hook 30 and the reduced diameter portion 40 meet defines an axially facing stop surface 42 for limiting the inward movement of the lock 90.

FIG. 7 shows an end view of the hook 30 and its reduced diameter portion 40. The cut-away section 41 reveals a flat surface 43 and an axially facing stop surface 42. The first notch 50 is positioned opposite the cut-away section 41. The second notch 51 is radially spaced from the first notch 50 by 90°. Therefore, the axially facing stop surfaces 54, 55 of the first and second notches 50, 51 independently interact with the lock 90 to securely affix the lock 90 to the hook 30. Furthermore, the reduced diameter portion 40 generally includes a semi-circular cross-section, while the main portion of the hook 30 maintains a generally circular cross-section. Where the generally semi-circular cross-section of the reduced diameter portion 40 meets the generally circular cross-section of the hook 30, defines the axially facing stop surface 42. The shape of the reduced diameter portion 40 restricts the rotational movement of the lock 90 on the hook 30, and locates the lock 90 at a specific radial position, determined by the cut-away section 41 and the notches 50, 51.

Figure 8:
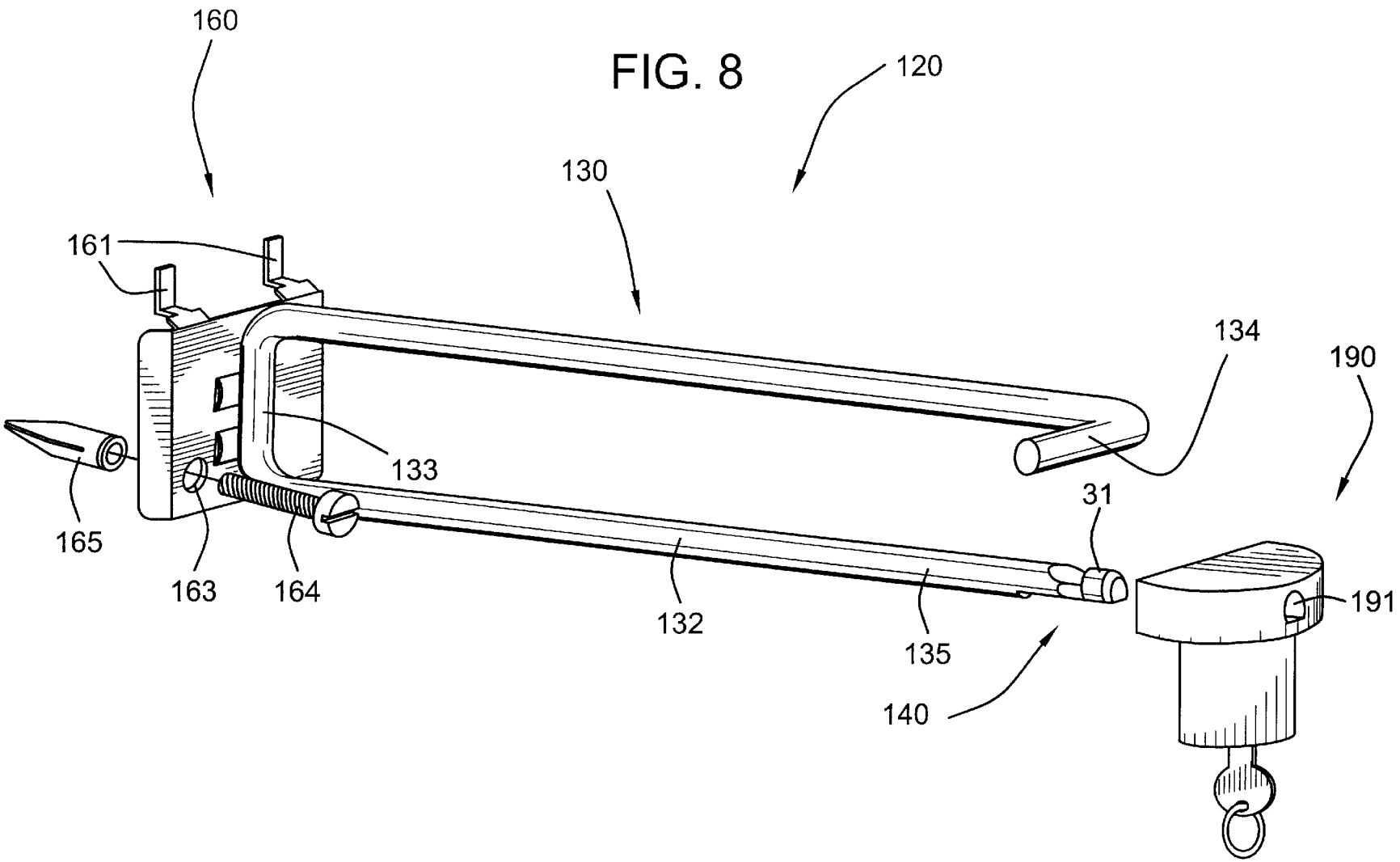
FIG. 8 is a perspective view of another embodiment of the locking hook assembly constructed in accordance with the teachings of the present invention.
Figure 9:
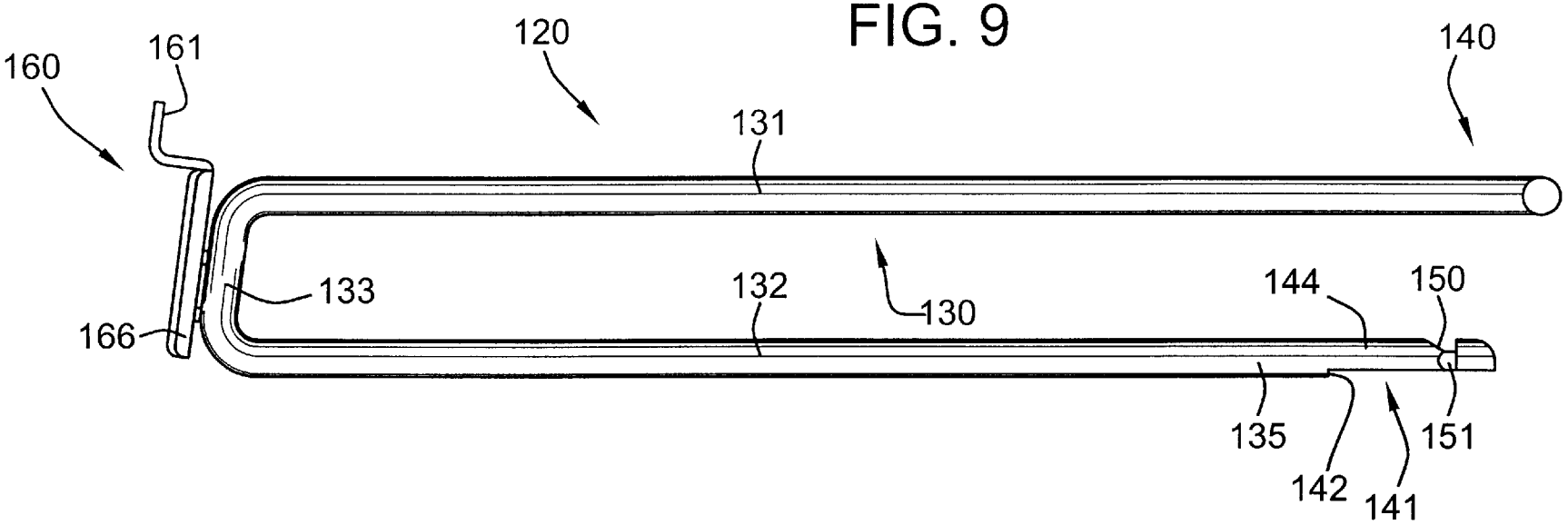
FIG. 9 is a side view of the locking hook assembly of FIG. 8.
Figure 10:
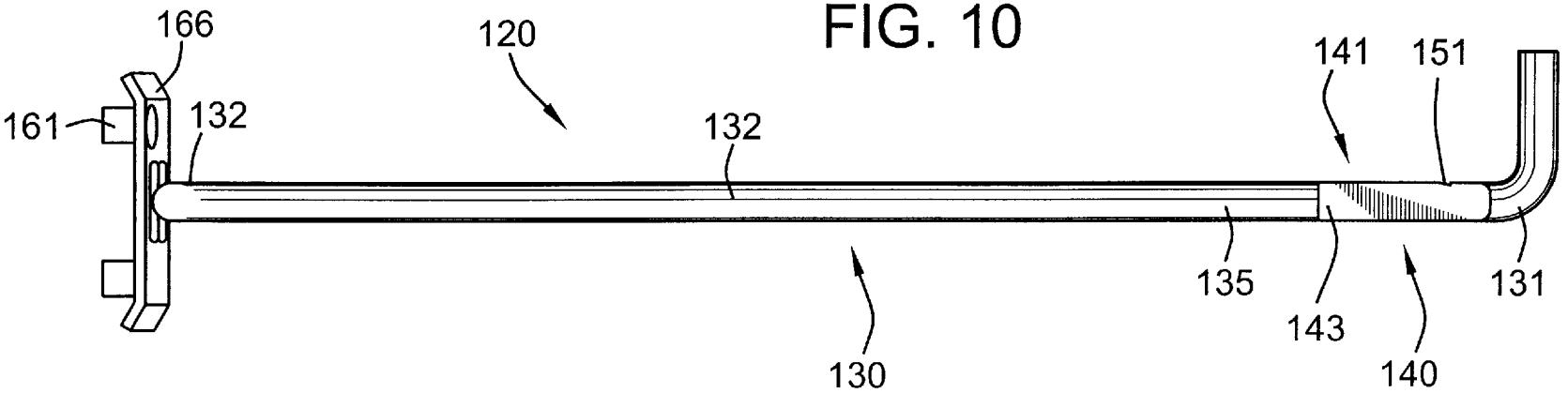
FIG. 10 is a bottom view of the locking hook assembly of FIG. 8.

FIGS. 8, 9 and 10 illustrate another embodiment of the locking hook assembly 120 constructed in accordance with the teachings of the present invention. The locking hook assembly 120 generally includes a hook 130, a mounting bracket 160, and a lock 190. The mounting bracket 160 is the same as the mounting bracket 60 depicted in FIG. 1, and is adapted to be securely mounted to a vertical support such as a pegboard via the pair of the ears 161. Further, the screw 164 and anchor 165 cooperate to clamp the mounting bracket 160 to the vertical support via the slots 163 in the mounting bracket 160. The lock 190 includes a bore 191 sized to correspond with the reduced diameter portion 140 of the hook 130. The lock 190 is selectively operated via a key, although a combination mechanism or other type of lock mechanism may be used.

Unlike the stem hook 30 of FIGS. 1 and 2, the hook 130 of the present embodiment is a scanning hook generally comprising an upper arm 131, a lower arm 132, and a connector 133 joining the inner ends of the upper and lower arms 131, 132. The connector 133 is fixed to, preferably by welding, the mounting bracket 160. The upper arm 131 includes an outer turned end 134 for receiving labels or label holders displaying a label to quickly show various information regarding the merchandise. The lower arm 132 includes an outer or free end 135 having the reduced diameter portion 140. As shown in FIGS. 9 and 10, the lower arm 132 and its reduced diameter portion 140 are constructed similarly to the hook 30 and its reduced diameter portion 40 depicted in FIGS. 1 through 7. It can therefore be seen that the present invention may be employed with a variety of types of display hooks, as taught by the stem and scanning hooks depicted herein.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A locking hook assembly for displaying merchandise on a vertical support, the locking hook assembly comprising:

a mounting bracket structured for connection to the vertical support;

a hook of generally circular cross-section having an inner end fixed to the mounting bracket and projecting outwardly therefrom to an outer end;

the hook's outer end having a reduced diameter portion of generally semi-circular cross-section, the reduced diameter portion including a first notch; and a lock having a generally semi-circular opening shaped to receive the reduced diameter portion, the lock selectively engaging the first notch to prevent removal of merchandise at the outer end.

2. The locking hook assembly of claim 1, wherein the first notch is formed into a curved outer surface of the reduced diameter portion.

3. The locking hook assembly of claim 1, further comprising a screw and anchor, and wherein the mounting bracket includes a hole sized to receive the screw, the screw and anchor cooperating to clamp the mounting bracket to the vertical support.

4. The locking hook assembly of claim 1, the reduced diameter portion further including a second notch.

5. The locking hook assembly of claim 4, wherein the second notch is located 90° radially from the first notch.

6. The locking hook assembly of claim 4, wherein the second notch is smaller than the first notch.

7. The locking hook assembly of claim 4, wherein the second notch is laterally opening.

8. The locking hook assembly of claim 4, wherein the hook defines a longitudinal axis, and wherein the first notch includes a first stop surface and the second notch includes a second stop surface, the first and second stop surfaces being disposed perpendicular to the longitudinal axis.

9. The locking hook assembly of claim 1, wherein the first notch is an upwardly opening.

10. The locking assembly of claim 1, wherein the hook comprises a scanning hook having an upper arm and lower arm, the lower arm having an outer end that includes the reduced diameter portion of generally semi-circular cross-section and having the first notch.

11. The locking hook assembly of claim 1, further comprising an axial facing stop surface formed where the hook portion of generally circular cross-section meets the hook portion of generally semi-circular cross-section, the stop surface limiting an inward movement of the lock.

12. A locking hook assembly for displaying merchandise on a vertical support, the locking ok assembly comprising:

a mounting bracket structured for connection to a vertical support;

a hook fixed to the mounting bracket and projecting outwardly therefrom, the hook having an annular outer surface;

a free end of the hook including a cut-away section defining an axially facing stop surface;

the free end of the hook further including a first notch, wherein the first notch is formed in the outer surface of the hook and positioned opposite the cut-away section; and a lock having an opening sized to receive the free end of the hook, the lock selectively engaging the first notch for locking the hook assembly.

13. The locking hook assembly of claim 12, wherein the cut-away section is defined by a generally flat outer surface portion.

14. The locking hook assembly of claim 12, wherein the hook comprises a scanning hook having an upper arm and lower arm, the lower arm having an outer free end that includes first notch and cut-away section.

15. A locking hook assembly for displaying merchandise on a vertical support, the locking hook assembly comprising:

a mounting bracket structured for connection to the vertical support;

a hook fixed to the mounting bracket and projecting outwardly therefrom;

a free end of the hook including a cut-away section defining an axially facing stop surface;

the free end of the hook further including a first, notch and a second notch, the second notch being located 90° radial from the first notch.

16. The locking hook assembly of claim 15, wherein the second notch is smaller than the first notch.

17. The locking hook assembly of claim 15, wherein the first notch is upwardly opening.

18. The locking hook assembly of claim 15, wherein the second notch is laterally opening.

19. The locking hook assembly of claim 15, wherein the hook defines a longitudinal axis, and wherein the first notch includes a first stop surface and the second notch includes a second stop surface, the first and second stop surfaces being disposed perpendicular to the longitudinal axis.

20. A locking hook assembly for displaying merchandise on a vertical support, the locking hook assembly comprising:

a mounting bracket structured for connection the vertical support;

a hook of generally circular cross-section having an inner end fixed to the mounting bracket and projecting outwardlly therefrom to an outer end;

the hook's outer end having a reduced diameter portion of generally semi-circular cross-section, the reduced diameter portion defining an axially facing stop surface, the reduced diameter portion including a first notch; and a lock having a generally semi-circular opening shaped to receive the reduced diameter portion, the stop surface limiting inward movement of the lock, the lock selectively engaging the first notch to prevent removal of merchandise at the outer end.

21. The locking hook assembly of claim 20, wherein the reduced diameter portion includes a second notch disposed radially from the first notch.

22. The locking hook assembly of claim 20, wherein the hook defines a longitudinal axis, and wherein the first notch includes a first stop surface and the second notch includes a surface, the first and second stop surfaces being disposed perpendicular to the longitudinal axis.

* * * * *

UNITED STATES PATENT AND TRADEMARK OFFICE

CERTIFICATE OF CORRECTION

PATENT NO. : 6,622,979 B2
DATED : September 23, 2003
INVENTOR(S) : Stanley C. Valiulis It is certified that error appears in the above-identified patent and that said Letters Patent is hereby corrected as shown below:

Column 5,
Line 27, change “ok” to -- hook --.

Column 6,
Line 8, delete the “,” after the word “first”.
Lines 30-31, change “out-wardlly” to -- out-wardly --.
Line 49, before “surface”, insert -- second stop --.

Signed and Sealed this

Fourth Day of May, 2004

JON W. DUDAS
*Acting Director of the United States Patent and Trademark Office*